United States Patent [19]

Gitter

[11] 4,118,822

[45] Oct. 10, 1978

[54] LOUVERED WINDOW CLEANER

[76] Inventor: John E. Gitter, 3258 N. 84th St., Milwaukee, Wis. 53222

[21] Appl. No.: 809,281

[22] Filed: Jun. 23, 1977

[51] Int. Cl.[2] ..... A47L 1/08; A47L 1/12

[52] U.S. Cl. ..... 15/121; 15/210 A

[58] Field of Search ..... 15/117, 121, 167 A, 15/210 A, 214, 245, 250.28, 394; 401/10, 22

[56] References Cited

U.S. PATENT DOCUMENTS

| | | | |
|---|---|---|---|
| 834,667 | 10/1906 | Flynn | 15/121 |
| 1,018,430 | 2/1912 | Lederer | 15/214 |
| 2,488,334 | 11/1949 | Schryner | 401/10 |
| 2,622,256 | 12/1952 | Vojacek | 15/210 A |
| 2,908,923 | 10/1959 | Schlecter | 401/10 |
| 2,957,190 | 10/1960 | Stark | 15/210 A X |
| 3,086,237 | 4/1963 | Haanen | 15/245 |
| 3,724,017 | 4/1973 | Mallory | 15/121 |

FOREIGN PATENT DOCUMENTS

| | | | |
|---|---|---|---|
| 79,605 | 7/1955 | Denmark | 15/210 A |

*Primary Examiner*—Daniel Blum

*Attorney, Agent, or Firm*—Andrus, Sceales, Starke & Sawall

[57] ABSTRACT

A louvered window cleaning device. The device comprises a handle, and two sets of holders extend laterally in opposite directions from the handle. Absorbent pads or strips are clamped within the holders of one set and the pads are spaced apart to define a slot that receives the louver window section to be cleaned. By moving the device along the window section, opposite surfaces of the window section will be cleaned. Rubber-like blades or squeegees are secured to the second set of holders and are similarly spaced apart to define a slot that receives the window section. Movement of the squeegees across the window section serves to remove the water from the opposite surfaces of the window section.

4 Claims, 3 Drawing Figures

LOUVERED WINDOW CLEANER

BACKGROUND OF THE INVENTION

Louver or jalousie-type windows consist of a series of glass sections, each having a width of about 4 to 5 inches. The glass sections are mounted at their side edges for pivotal movement and through operation of a crank operated drive mechanism the window sections can be moved between a generally vertical closed position and a generally horizontal open position.

Because of the shape and mounting of the glass sections, it is difficult to clean both the inner and outer surfaces of the sections. In the past, rags or sponges have been used to clean the window sections and a dry rag has been employed to dry the sections. This type of operation requires several pieces of equipment and is very time consuming.

The U.S. Pat. No. 2,903,729 to Rattey shows a squeegee for drying or removing the water from louvered windows. With the device shown in the aforementioned patent, a pair of blades or squeegees extend longitudinally from a handle and the window section is inserted between the blades and run along the window section to remove the water. With the device of the aforementioned patent, the upper and lower surfaces of the window section must be cleaned by a separate device, such as a sponge or rag, before the squeegee can be utilized.

SUMMARY OF THE INVENTION

The invention relates to a device for cleaning louvered windows. In accordance with the invention, the device comprises a handle and two sets of generally parallel holders extend laterally in opposite directions from the handle. The holders of each set are generally channel-shaped in cross section with the open side of the channels facing each other. Absorbent, slightly abrasive, sponge-like pads are clamped within one set of the holders and the pads are spaced apart to define a slot that receives the window section. By drawing the pads across the window section both the upper and lower surfaces of the section will be cleaned.

Secured within the holders of the second set are rubber-like squeegees or blades, which are spaced apart to define a slot to receive the window section. After each window section has been cleaned, the section is inserted between the blades and by drawing the device across the window section, both the upper and lower surfaces of the window sections will be dried.

The invention provides a single tool which can be used for both cleaning and drying louvered window sections. Only one hand is required to use the device and this is a distinct advantage, particularly where the window washer may be required to stand on a platform, ladder, or scaffold.

By virtue of the construction of the device, the cleaning pads will simultaneously contact opposite surfaces of the window section to provide an effective cleaning of both surfaces. Similarly, the blades or squeegees are spaced relative to each other so that both squeegees will simultaneosuly contact the opposite surfaces of the window section to effectively remove the water or dry the section with a single stroke of movement. This substantially reduces the time involved in washing louvered windows, as compared with devices as used in the past.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
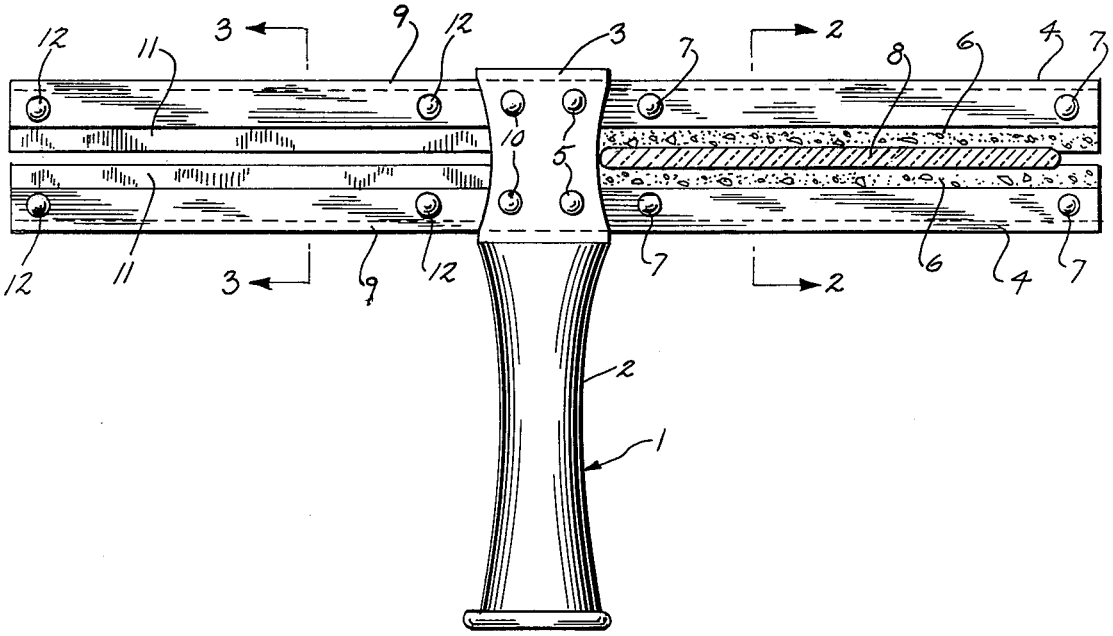
FIG. 1 is a plan view of the louver window cleaning device of the invention.

The drawings illustrate a device for cleaning louvered or jalousie-type windows, which comprises a handle 1 having an inner section 2 which defines a hand grip and an outer section 3.

A pair of channel-shaped holders 4 or clamps extend laterally outward from the outer section 3 with the open sides of the channel-shaped holders facing each other. The holders 4 are connected to the outer section 3 through use of rivets 5 or other suitable fasteners.

Figure 2:
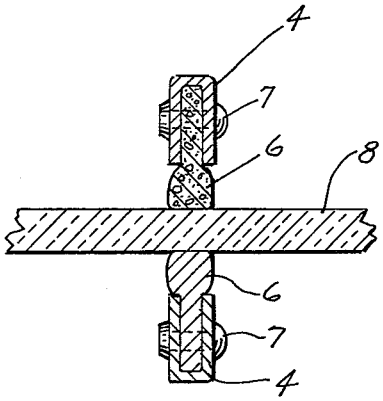
FIG. 2 is a section taken along line 2—2 of FIG. 1.

Cleaning pads or strips 6 are secured within each holder 4 by rivets 7 or other types of fasteners. As illustrated in FIG. 2, the inner portion of each pad 6 which is clamped between the sides of the holder 4 is in a compressed state, while the outer portion of each pad has a larger cross section.

The pads can be formed of any absorbent material, such as plastic or cellulosic materials, which is capable of absorbing or holding a cleaning liquid. It is also desirable that the pads have a slightly abrasive character so that they can effectively clean dirt, film and other materials from the glass window sections.

The pads or strips 6 are spaced slightly apart, in the neighborhood of approximately ⅛ inch, and define a slot which receives the glass window section 8 to be cleaned. By moving the pads across the window section, the pads will effectively clean both the upper and lower surfaces of the window section.

A second pair of clamps or holders 9 extend outwardly from outer section 3, and holders 9 also have a channel-shaped cross section with the open sides of the channels facing toward each other. The inner ends of the holders 9 are connected to the outer section 3 through rivets 10.

Figure 3:
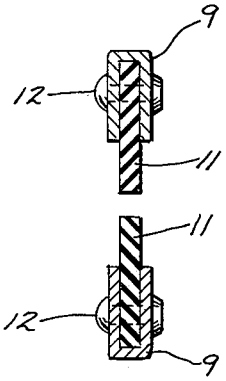
FIG. 3 is a section taken along line 3—3 of FIG. 1.

As best shown in FIG. 3, a rubber-like squeegee or blade 11 is secured or clamped within each of the holders 9, through use of rivets 12 or the like.

The free extremities of the squeegee or blades are spaced apart a distance of approximately ⅛ inch and define a slot which receives the glass window section 8. By drawing the squeegee across the window section, the water will be simultaneously removed from both the upper and lower surfaces of the section.

The window cleaning device of the invention is a single tool which effectively acts to both clean and dry louver-type windows without the necessity for auxilliary equipment. The device can be operated with one hand which is an advantage, particularly when the window washer may be standing on a ladder, or other type of elevated support.

While the drawings illustrate the pads 6 and squeegees 11 as being permanently attached to the respective holders or clamps, it is contemplated that if the device is designed for professional use, the pads and squeegees may be replaceable. With a replaceable construction, the squeegees and pads would be slidable within the channel-shaped holders so that they could be readily removed and replaced.

Various modes of carrying out the invention are contemplated as being within the scope of the following claims particularly pointing out and distinctly claiming the subject matter which is regarded as the invention.

I claim:

1. A device for cleaning louvered windows, comprising a handle, a first pair of generally parallel holders extending laterally in spaced relation from the handle substantially in the plane thereof, an absorbent strip adapted to hold cleaning liquid secured to each of said first holders with said pads being spaced apart to define a first slot to receive the window section to be cleaned, drawing said device across the window section acting to clean opposite surfaces of said window section, a second pair of generally parallel holders extending laterally in spaced relation and in the opposite direction from said handle, and a flexible squeegee blade member secured to each of said second holders, said squeegee members being spaced apart to define a second slot to receive said window section, movement of said squeegee members across the window section serving to simultaneously remove the cleaning liquid from opposite surfaces of said window section.

2. The device of claim 1, wherein said strips are formed of a slightly abrasive material.

3. The device of claim 1, wherein each of said first and second holders has a generally channel-shape with the open sides of the channels facing each other and the outer ends of the channels being open, whereby said strips and said squeegee members can be slid into position through the respective open ends.

4. The device of claim 1, in which the slots are in longitudinal alignment.

* * * * *